United States Patent [19]

Robertson

[11] 4,172,460

[45] Oct. 30, 1979

[54] HAND OPERATED SMOKING DEVICE

[75] Inventor: Alexander B. Robertson, Austin, Tex.

[73] Assignee: Oat Willie's Department Store, Inc., Austin, Tex.

[21] Appl. No.: 820,221

[22] Filed: Jul. 29, 1977

[51] Int. Cl.[2] ..... A24F 7/02; A24F 13/22

[52] U.S. Cl. ..... 131/175; 131/171 R; 131/198 A

[58] Field of Search ..... 131/172, 171 R, 171 A, 131/174, 175, 187, 198 R, 198 A, 170 A, 170 R; 46/9, 44, 7; 285/6

[56] References Cited

U.S. PATENT DOCUMENTS

| | | | |
|---|---|---|---|
| 402,681 | 5/1889 | Lindeman | 131/171 |
| 2,510,909 | 6/1950 | Schuelein | 131/171 |
| 2,960,981 | 11/1960 | Robertson | 131/171 R X |
| 3,318,315 | 5/1967 | Orter | 131/171 R |
| 3,417,757 | 12/1968 | Killen et al. | 131/171 |

*Primary Examiner*—Robert W. Michell
*Assistant Examiner*—V. Millin
*Attorney, Agent, or Firm*—Laff, Whitesel & Rockman

[57] ABSTRACT

A smoking device is provided which is hand operated and does not require suction or mouth contact.

3 Claims, 3 Drawing Figures

HAND OPERATED SMOKING DEVICE

This invention relates to smoking devices and more particularly to hand operated smoking devices.

Present day smoking devices are generally operated by a suction means. The suction means most often employed is the human mouth. A typical smoking device might, for example, employ a bottle or other container and a tube with a mouthpiece. One disadvantage of the arrangement is that several persons may use the same mouthpiece, thus causing an unsanitary exchange between these persons. A second disadvantage is that the glass components are breakable. A third disadvantage is that the glass container-tube devices are unwieldly and cannot be easily shared by several persons. Finally, these devices are often expensive. Thus, there is a need for a simple, sanitary, and inexpensive smoking device.

Accordingly, an object of this invention is to provide a new and improved smoking device. A more particular object of this invention is to provide a simple and inexpensive hand operated smoking device which may be used as quickly and easily as conventional smoking devices.

In keeping with one aspect of this invention, a narrow short tube of chopped smoking substance enclosed in paper is held on the flanged end of a stem which passes through a washer which sits in a cap. The cap is secured by threaded means to a squeezable plastic bottle with an air hole on one side. A mouthpiece is fitted over the opposite end of the flange.

The above-mentioned and other features of this invention and the manner of obtaining them will become more apparent, and the invention itself will be best undestood by reference to the following description of an embodiment of the invention taken in conjunction with the accompanying drawings, in which.

Figure 3:
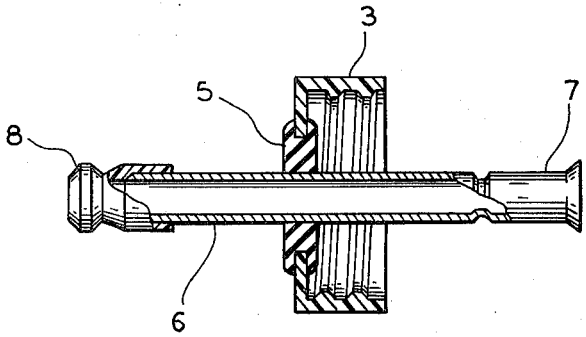
FIG. 3 is a cross-sectional view of the cap, washer, stem and mouthpiece forming part of the inventive smoking device.

A cross-sectional view of the cap assembly including cap 3, washer 5, stem 6 and mouthpiece 8 is shown in FIG. 3.

Figure 1:
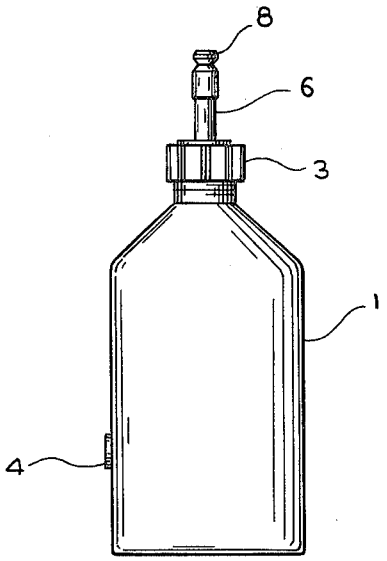
FIG. 1 is a side elevational view of the inventive smoking device.
Figure 2:
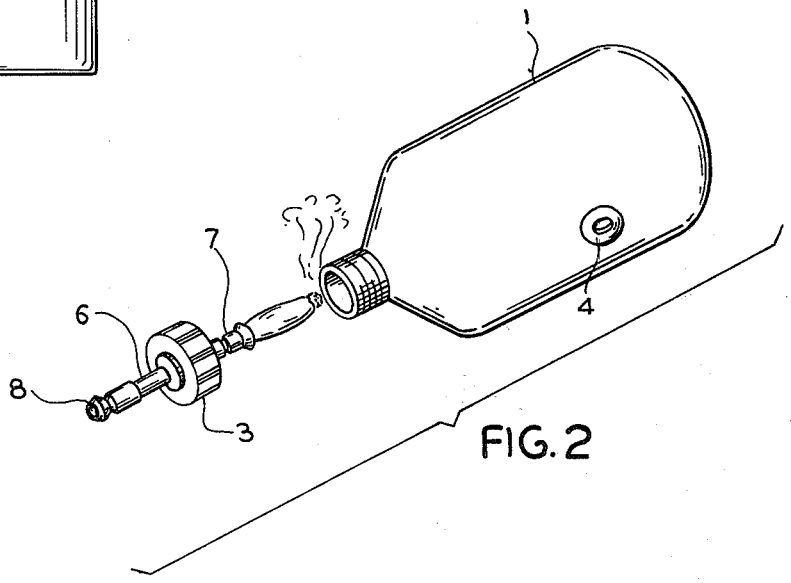
FIG. 2 is an exploded perspective view which shows the principles of the inventive smoking device.

As shown in FIGS. 1 and 2, a hand operated smoking device constructed in accordance with this invention comprises a bottle 1 with threading means 2 and cap 3. The bottle 1 is made of a resilient material such as a pliable plastic, and has an air hole 4 which is used to regulate the air taken into the bottle. The cap is fitted with a washer means 5 through which a stem 6 passes. Washer 5 forms a seal between stem 6 and cap 3. One end 7 of the stem 6 extends into the bottle and is flanged, and the other end extends outward from cap 3 and has a mouthpiece 8.

The operation of this device is as follows. A short tube of smoking substance rolled in paper is inserted into the flanged end 7 of the stem 6. The smoking substance is then lit. The cap 3 is screwed on the bottle 1 by use of the threading means 2. The user then grasps the bottle 1 with one hand, covering the air hole 4 with the thumb. By squeezing the bottle 1 slowly, smoke is ejected through the stem 6 and out the mouthpiece 8 into the mouth of one using the device. Removing the thumb from the air hole 4 allows the bottle to refill with air, and the above steps may then be repeated. The quantity of smoke reaching the user's mouth is greater than can be obtained by normal inhaling.

While the principles of the invention have been described above in connection with specific apparatus and applications, it is to be understood that this description is made only by way of example and not as a limitation on the scope of the invention.

I claim:

1. A hand operated smoking device comprising a bottle and cap combination, said bottle made of a resilient material, an aperture in said cap, a hollow stem extending through said aperture whereby a first portion of said stem extends into said bottle, and a second portion of said stem extends outward from said cap, means creating a seal between said stem and cap, flanged means on said first portion of said stem adopted to hold a smoking product, and an aperture in said bottle to allow regulation of the air taken into said bottle.

2. The smoking device of claim 1 wherein said second portion of said stem includes a mouthpiece.

3. The smoking device of claim 1 wherein said seal comprises a washer through which said stem extends.

* * * * *